US008152257B2

(12) United States Patent
Kim

(10) Patent No.: US 8,152,257 B2
(45) Date of Patent: Apr. 10, 2012

(54) DOOR BASKET FOR REFRIGERATOR

(75) Inventor: Jin Yong Kim, Changwon-si (KR)

(73) Assignee: LG Electronics Inc., Seoul (KR)

( * ) Notice: Subject to any disclaimer, the term of this patent is extended or adjusted under 35 U.S.C. 154(b) by 1042 days.

(21) Appl. No.: 12/062,244

(22) Filed: Apr. 3, 2008

(65) Prior Publication Data

US 2008/0246381 A1 Oct. 9, 2008

(30) Foreign Application Priority Data

Apr. 4, 2007 (KR) ..... 10-2007-0033456

(51) Int. Cl.
*A47B 96/04* (2006.01)

(52) U.S. Cl. ..... 312/405.1

(58) Field of Classification Search ..... 312/300, 312/321.5, 408, 402, 404, 405, 405.1; 62/377
See application file for complete search history.

(56) References Cited

U.S. PATENT DOCUMENTS 1,250,959 A * 12/1917 Brown ..... 428/99
3,484,891 A * 12/1969 Borgen ..... 16/86 R
4,186,978 A * 2/1980 Thomson ..... 312/321.5
5,289,616 A * 3/1994 Taniyama ..... 16/376
5,931,554 A * 8/1999 Koopman ..... 312/405
6,074,030 A * 6/2000 Prunty et al. ..... 312/404
6,295,697 B1 * 10/2001 Simon ..... 16/86 R
6,905,183 B2 * 6/2005 Leimkuehler et al. ..... 312/405.1
2002/0117947 A1 * 8/2002 Cheng ..... 312/327
2003/0102787 A1 * 6/2003 Whitaker et al. ..... 312/405.1
2004/0004421 A1 * 1/2004 Han ..... 312/404
2004/0178711 A1 * 9/2004 Avendano ..... 312/405.1
2005/0073227 A1 * 4/2005 Shin ..... 312/404
2010/0270902 A1 * 10/2010 Kim et al. ..... 312/405.1

* cited by examiner

*Primary Examiner* — James O Hansen
*Assistant Examiner* — Matthew Ing
(74) *Attorney, Agent, or Firm* — Birch, Stewart, Kolasch & Birch, LLP

(57) ABSTRACT

Provided is a door basket for a refrigerator. The door basket includes a case, a cover, and a contact member. The case is mounted on a rear side of a refrigerator door and forms a space for receiving food. The cover is axially coupled between both sides of the case and selectively shielding the case through up/down rotation. The contact member is provided on an inner side of the case contacting one end of the cover when the cover is completely opened, and formed of an electrical material to relieve a contact impact with the cover.

9 Claims, 5 Drawing Sheets

[fig.1]
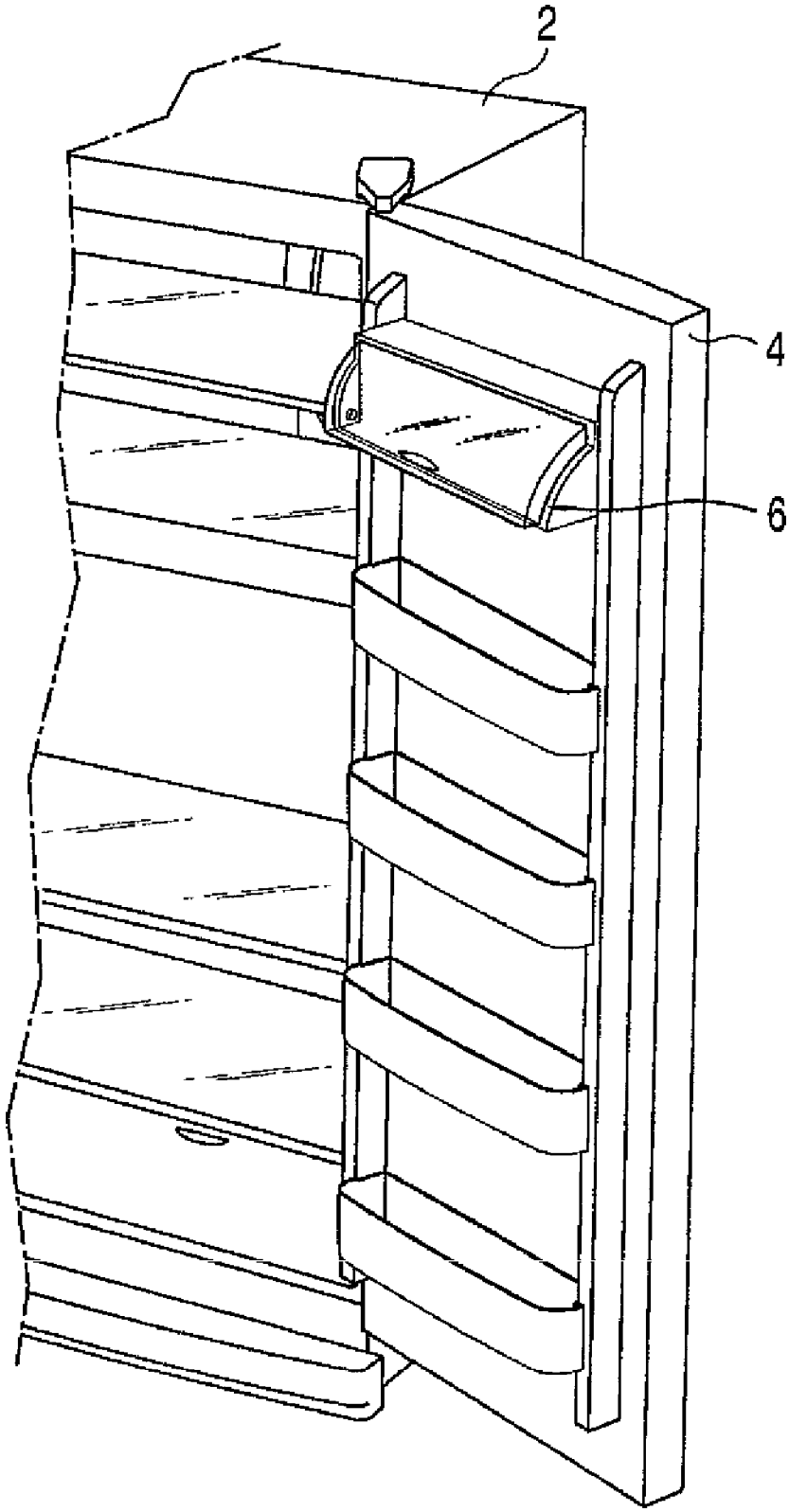

[fig.2]
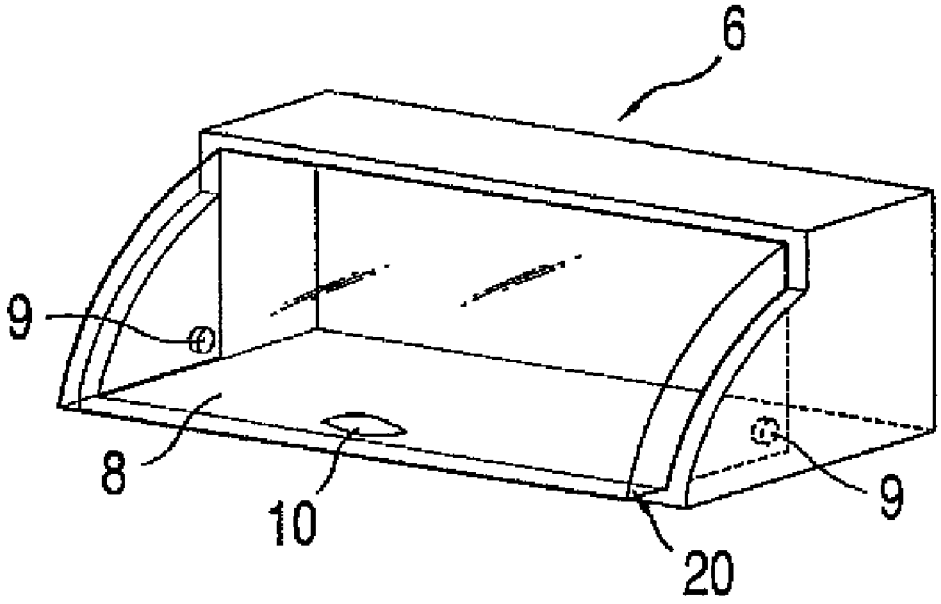
[fig.3]
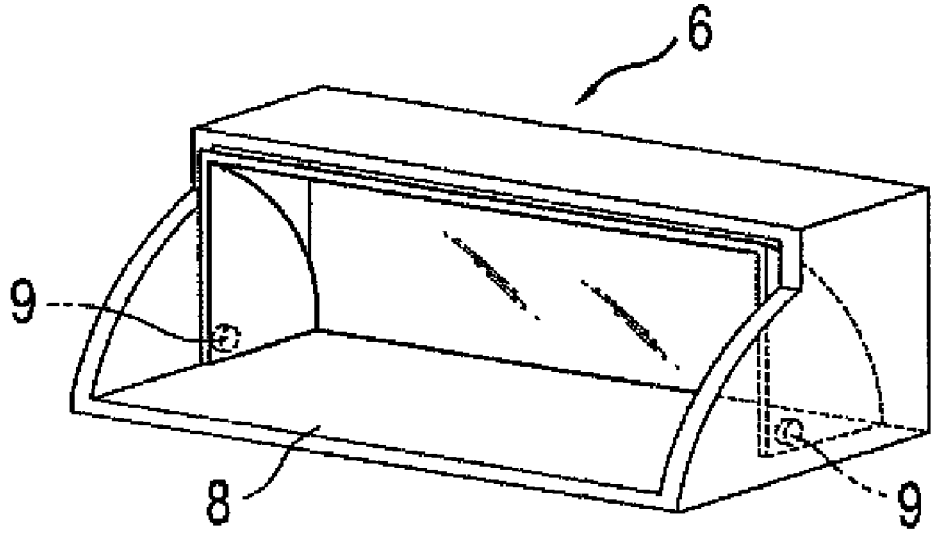

[fig.4]
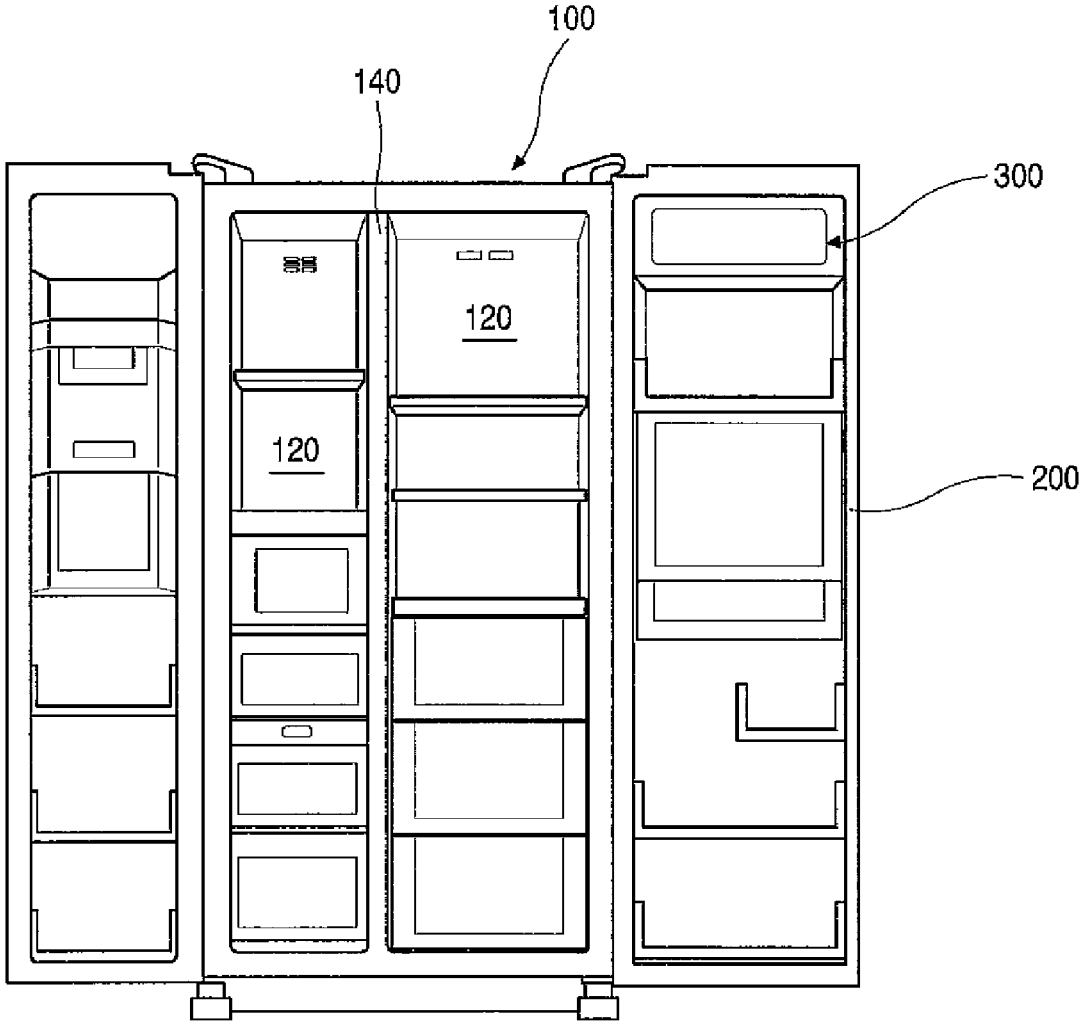

[fig.5]
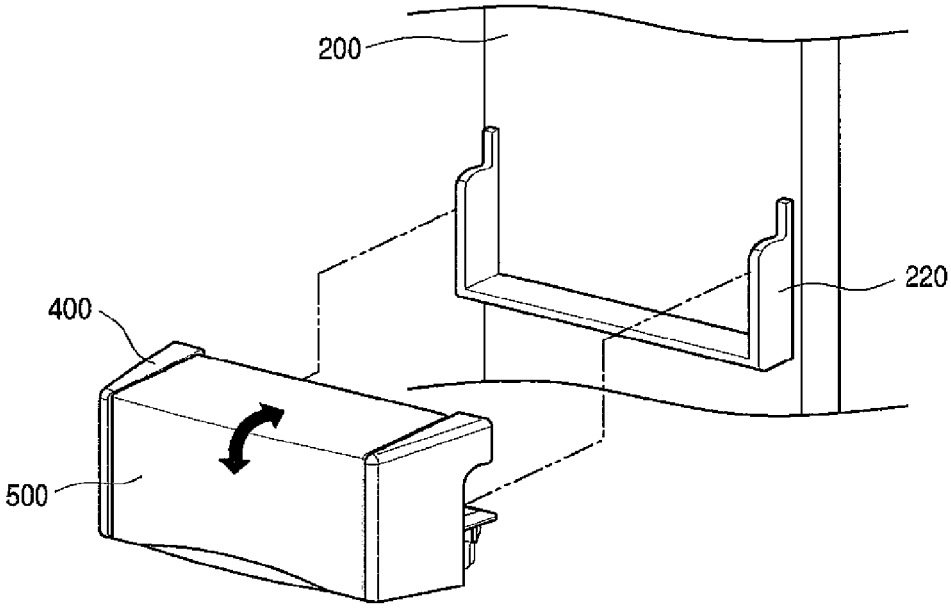
[fig.6]
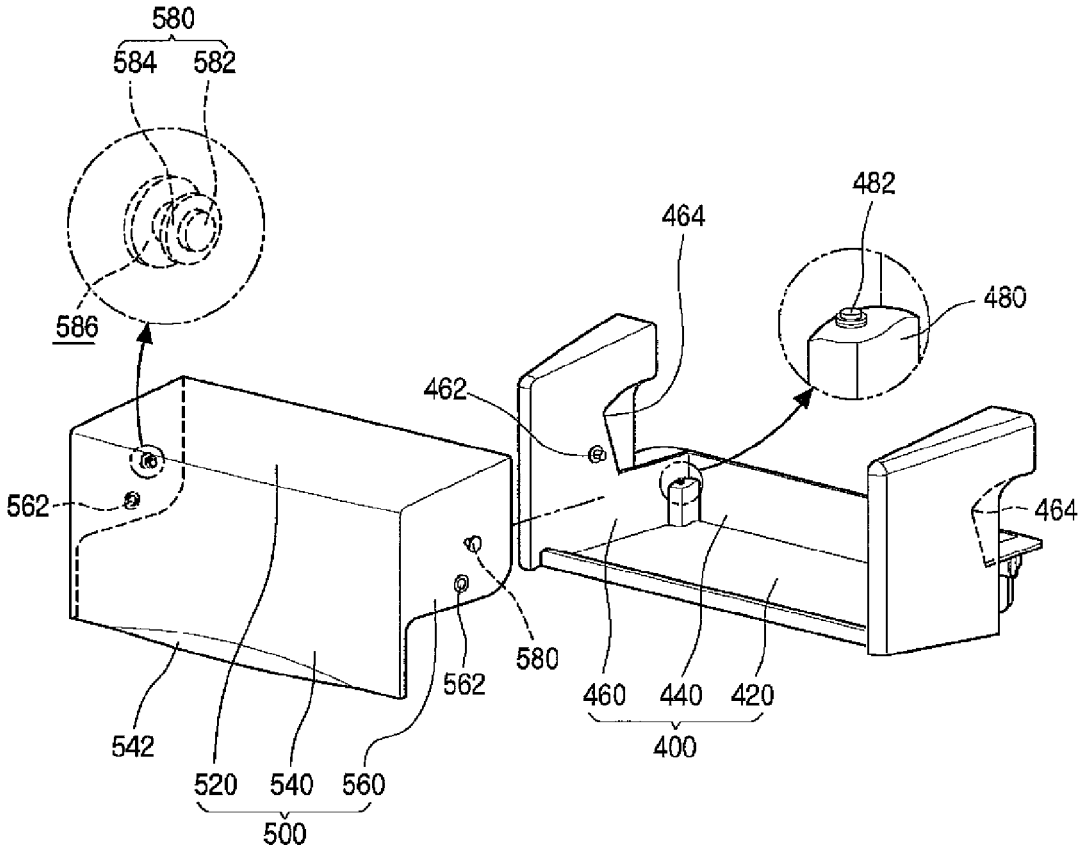

[fig.7]
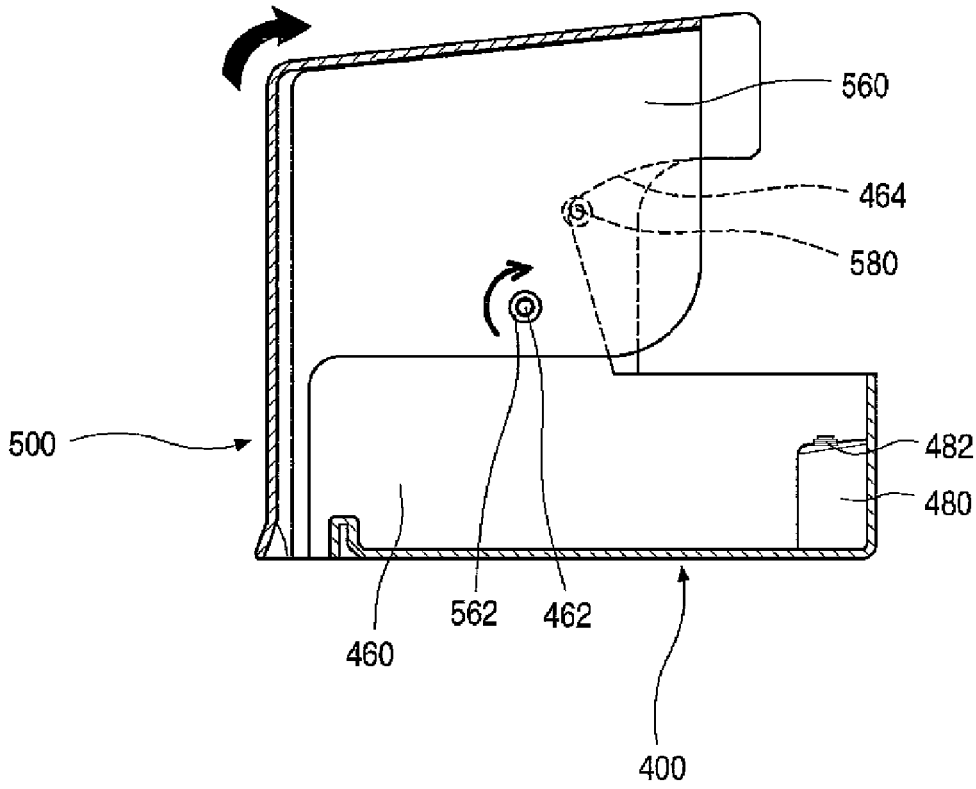
[fig.8]
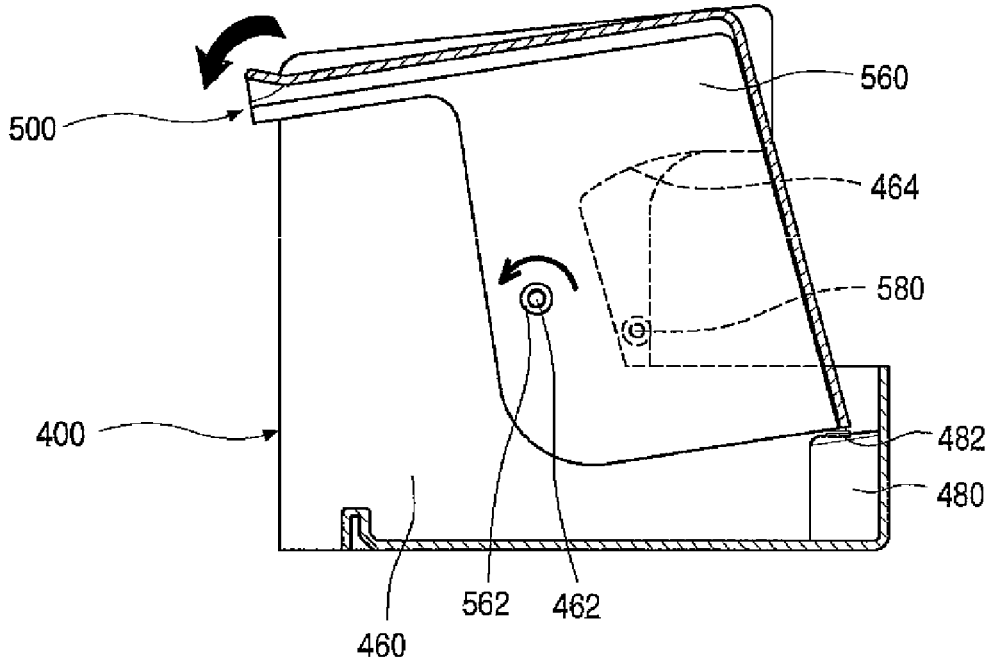

DOOR BASKET FOR REFRIGERATOR

BACKGROUND

The present disclosure relates to a door basket for a refrigerator.

Generally, a refrigerator is an electronic appliance for storing food at low temperature in an inside storage space shielded by a refrigerator door. The refrigerator can store food at an optimum state by cooling the storage space using cooling air generated through heat exchange with refrigerant circulating a cooling cycle.

The size of the refrigerator tends to increase more and more and multi-functions are provided to the refrigerator as dietary life changes and pursues high quality, and accordingly, refrigerators of various structures with consideration of user convenience are brought to the market.

Also, a plurality of drawers, racks, and baskets for storing various food in an optimum state are provided to a storage space inside a refrigerator and on the rear side of a refrigerator door. Therefore, the inside of the refrigerator and the storage space of the door are divided by these drawers, the racks, and the baskets to store suitable food.

Particularly, food such as cheese and butter may be overly cooled and change into low quality, or moisture of the food evaporates, so that the food may change in its color or rot when it is maintained at low temperature and exposed to cooling air too much. Accordingly, the food should be stored in a space that can maintain a constant storage environment. For this purpose, a separate storage space is formed in the rear side of a refrigerator door.

The construction of a related art refrigerator is described below with reference to FIG. 1.

FIG. 1 is a partial perspective view illustrating a related art refrigerator door is open, and FIGS. 2 and 3 are perspective views illustrating the opened/closed state of the door basket of a related art refrigerator.

Referring to FIGS. 1 to 3, a basket-shaped milk product storage 6 for storing a milk product such as cheese and butter is provided to the uppermost portion of a cooling room door 4 of a refrigerator 2.

In the milk product storage 6, an about quarter cylinder shaped door 8 is rotatably coupled to the basket of the cooling room door 4 through a hinge 9. Accordingly, when the door 8 is pushed upward by a knob 10 of the door 8, the door 8 is opened as illustrated in FIG. 3, so that milk products such as cheese and butter can be put in and taken out to/from the milk product storage 6.

However, a related art has the following limitations. According to the related art, when the door 8 selectively shielding the milk product storage 6 rotates, the end of the door 8 collides with the milk product storage 6 to complete an opening/closing operation.

That is, the door 8 and the milk product storage 6 made of plastics indispensably collide with each other during an operation of opening/closing the door 8, so that both the front and rear ends of the door 8 entirely collide with the milk product storage 6 to generate a considerable impact. Accordingly, not only a noise is generated but also the plastic door 8 may be destroyed.

SUMMARY

In one embodiment, a door basket for a refrigerator includes: a case mounted on a rear side of a refrigerator door and forming a space for receiving food; a cover axially coupled between both sides of the case and selectively shielding the case through up/down rotation; and a contact member on an inner side of the case contacting one end of the cover when the cover is completely opened, and formed of an electrical material to relieve a contact impact with the cover.

In another embodiment, a door basket for a refrigerator includes: a case detachably coupled on a rear side of a refrigerator door and forming a receiving space whose upper and front sides are open; a cover coupled to the case, to be rotatable in up/down directions, the cover selectively shielding the receiving space of the case; interference protrusions provided on both sides of the cover, respectively, and protruding to an outside; and restriction ends on both sides of the cover corresponding to a movement path of the interference protrusions, the restriction ends contacting the interference protrusions to restrict a shielding rotation of the cover when the cover is closed.

The details of one or more embodiments are set forth in the accompanying drawings and the description below. Other features will be apparent from the description and drawings, and from the claims.

BRIEF DESCRIPTION OF THE DRAWINGS

FIG. 1 is a partial perspective view illustrating a related art refrigerator door is open.

FIG. 2 is a perspective view illustrating the closed state of the door basket of a related art refrigerator.

FIG. 3 is a perspective view illustrating the opened state of the door basket of a related art refrigerator.

FIG. 4 is a front view illustrating a door of a refrigerator to which a door basket of a refrigerator according to an embodiment is adopted is opened.

FIG. 5 is a perspective view illustrating the appearance of a door basket of a refrigerator according to an embodiment.

FIG. 6 is an exploded perspective view illustrating the construction of a door basket of a refrigerator according to an embodiment.

FIG. 7 is a side cross-sectional view illustrating a door basket of a refrigerator according to an embodiment is closed.

FIG. 8 is a side cross-sectional view illustrating a door basket of a refrigerator according to an embodiment is opened.

DETAILED DESCRIPTION OF THE EMBODIMENTS

Reference will now be made in detail to the embodiments of the present disclosure, examples of which are illustrated in the accompanying drawings. However, the present disclosure is not limited to proposed embodiments, and it would be obvious to those skilled in the art to derive other inventions or other embodiments that come within the scope of the present disclosure through addition, modifications, and deletion of elements.

Also, though a home bar door and a manufacturing method thereof according to an embodiment can be applied to all types of refrigerators where a basket is provided to a door regardless of the type of refrigerator, description will be made using a side-by-side type refrigerator as an example for convenience.

FIG. 4 is a front view illustrating a door of a refrigerator to which a door basket of a refrigerator according to an embodiment is adopted is opened. Referring to FIG. 4, a rectangular refrigerator main body 100 including a storage space 120 therein forms the appearance of the refrigerator.

Also, a barrier 140 dividing the inside of the refrigerator main body 100 into left and right sides is provided inside the refrigerator main body 100. Therefore, the barrier 140 divides the storage space 120 of the refrigerator main body 100 to the left and right sides to form a freezing room and a cooling room.

Also, the front side of the refrigerator main body 100 is open, and a pair of refrigerator doors 200 is provided to the open front side. The refrigerator doors 200 are rotatably mounted to the refrigerator main body 100 to selectively shield the open front side of the refrigerator main body 100, and rotate to the left and right sides, respectively, to selectively shield the freezing room and the cooling room.

Meanwhile, a plurality of drawers, racks, and baskets for receiving food are provided in the storage space 120 inside the refrigerator main body 100 and on the rear side of the refrigerator door 200.

That is, a plurality of racks vertically dividing the storage space 120 into a plurality of spaces are provided inside the refrigerator main body 100. A plurality of drawers forming separate independent receiving spaces inside the storage space are provided.

Also, a plurality of receiving spaces are vertically provided with a constant interval on the rear side of the refrigerator door 200. Food contained in a long case such as bottles or cans that should be stored upright is stored in these receiving spaces.

Meanwhile, a door basket 300 for storing food such as a milk product requiring an independent storage space is provided to the uppermost portion of the rear side of the refrigerator door 200. A portion of the door basket 300 is rotatable to selectively open/close a receiving space inside the door basket 300. With these construction, food stored inside the door basket 300 is protected from excessive cooling air supplied to the storage space 120, and moisture evaporation of the food is prevented.

The door basket 300 is described in more detail with reference to the accompanying drawings.

FIG. 5 is a perspective view illustrating the appearance of a door basket of a refrigerator according to an embodiment, and FIG. 6 is an exploded perspective view illustrating the construction of a door basket of a refrigerator according to an embodiment.

Referring to FIGS. 5 and 6, the door basket 300 includes a case 400 forming a receiving space, and a cover 500 rotatably mounted to the case 400 to selectively open/close the receiving space.

The case 400 not only forms the receiving space of the door basket 300 but also is formed in a shape corresponding to a formation end 220 so that the door basket 300 can be mounted on the formation end formed on the rear side of the refrigerator door 200.

The formation end 220 is designed for supporting and mounting the case 400, formed by a door liner forming the rear side of the refrigerator door 200, and protrudes in such a shape as to receive the left and right ends of the case 400. Also, to support the case 400 from the lower portion, a corresponding position can protrude.

Also, the front side and the upper side of the case 400 are entirely open, and the rear side of the case 400 is partially open. The open front and upper sides are shielded by the cover 500. That is, the case 400 includes a case lower side 420, case lateral sides 460, and a case rear side 440. The front side and the upper side of the case 400 are entirely open to expose the inside of the case 400.

The case lower side 420 forms the lower surface of the case 400 and is formed in a quadrangular shape having a predetermined area. At this point, the horizontal width of the case lower side 420 corresponds to the horizontal distance of the formation end 220 to allow the case 400 to be mounted. Also, the case lateral sides 460 are formed at both ends of the case lower side 420.

The case lateral sides 460 form both lateral sides of the case 400, and extend vertically by a predetermined height from both ends of the case lower side 420.

The case lateral side 460 is formed in an about triangular shape when seen from an upper direction to have an increasing width from the front side to the rear side. The rear end of the case lateral side 460 contacts the formation end 220 on the rear side of the refrigerator door 200 to allow the door basket 300 to be closely mounted on the refrigerator door 200.

At this point, the outer surface of the case lateral side 460 and the outer surface of the formation end 220 form the same surface when the case 400 is mounted, so that an elegant surface is formed without a protrusion.

Also, a region ranging from the rear upper portion of the case lateral side 460 to the rear lower end of the case lateral side 460 has a shape recessed to the front more or less. At this point, the recessed shape of the case lateral side 460 is different in its inner surface and its outer surface.

That is, the outer rear end of the case lateral side 460 protrudes and is recessed to correspond to the shape of the formation end 220 on which the door basket 300 is mounted. Also, the inner rear end of the case lateral side 460 is recessed to the front in its central portion to form a restriction end 464 having an about '⊏'shape.

The restriction end 464 selectively contacts interference protrusions 580 of the cover 500 which will be described below in detail to restrict rotation of the cover 500. The restriction end 464 is configured to contact the interference protrusions 580 while the interference protrusions 580 move.

The restriction end 464 is recessed to the front further than the outer rear end of the case lateral side 460. The restriction end 464 is not exposed to the outer side of the case 400, and is recessed to the front by a predetermined depth when seen from the lateral side. Also, the restriction end 464 may be located to the rear more or less compared to the position of a rotation protrusion 462 which will be described below.

The shape of the restriction end 464 is described in more detail. The lower end of the restriction end 464 has the same height as the height of the case rear side 440 and is parallel to the case lower side 420. Also, the front end of the restriction end 464 is inclined to the front from the lower direction to the upper direction, and the upper end of the restriction end 464 is bent to the upper direction so that it has a predetermined curvature.

Also, the corner portion of the restriction end 464 where its upper end and its front end meet is formed in a rounded shape, not a right angle. The corner portion is formed to have a curvature corresponding to the outer peripheral surface of the interference protrusion 580 to stably contact the interference protrusion 580 right before the cover 500 is completely closed.

Of course, the restriction end 464 may not be formed in a shape recessing inward the rear end of the case lateral side 460, but can be replaced by a rib protruding or a groove recessed from a corresponding position inside the case lateral side 460.

Meanwhile, the lower portion of the case lateral side 460 extends further to the rear than the upper portion of the case lateral side 460, and is connected with the case rear side 440 to closely contact the rear side of the refrigerator door 200.

Meanwhile, the rotation protrusion 462 is formed at about a central portion of the inner surface of the case lateral side 460. The rotation protrusion 462 is designed for rotation of the cover 500 mounted on the case 400. The rotation protrusion 462 protrudes so that it can be inserted into a rotation hole 562 which will be described below.

That is, the rotation protrusion 462 protrudes perpendicularly in an inner direction from the inner surface of the case lateral side 460, and is inserted into the rotation hole 562 when the cover 500 is mounted.

The case rear side 440 forms the rear appearance of the case 400, and extends upward by a predetermined length in a vertical direction from the rear end of the case lower side 420. Both lateral ends of the case rear side 440 are connected to the lower portions of the case lateral sides 460.

At this point, the case rear side 440 is formed to have the same height as the lower end of the restriction end 464 of the case lateral side 460. Also, the case 400 is closely attached on the rear side of the refrigerator door 200. At this point, the case rear side 440 is closely attached to the refrigerator door 200. Accordingly, the open rear side of the case 400 can be shielded by the refrigerator door 200.

Meanwhile, supports 480 are formed on both sides of the inner rear portion of the case 400. The supports 480 contact one side of the cover 500 when the cover 500 rotates. The supports 480 are formed at both corners, respectively, where the case lower side 420, the case lateral sides 460, and the case rear side 440 contact one another.

That is, the supports 480 are formed at rear left and right corners of the case lower side 420, and contact the case lateral sides 460 and the case rear side 440. The support 480 protrudes upward by a predetermined height from the upper surface of the case lower side 420, and may extend up to the about middle height of the case rear side 440.

Also, the upper surface of the support 480 contacts the end of the cover 500. A contact member 482 is provided on the upper surface of the support 480 contacting the end of the cover 500. The contact member 482 is designed for relieving an impact generated upon contact with the end of the cover 500, and may be formed of a elastically deformable material such as rubber, sponge, and Styrofoam that can absorb an impact.

Meanwhile, the cover 500 mounted on the case 400 shields the open surface of the case 400, and is rotatably coupled to the case 400 between the case lateral sides 460 of the case 400. The cover 500 is formed in a shape that can completely shield the open upper side and front side of the case 400.

Therefore, the cover 500 can selectively shield the open sides of the case 400 through rotation. The cover 500 is formed in a transparent or semi-transparent material, so that food received inside the case 400 can be easily recognized from the outside.

In more detail, the cover 500 includes a cover upper side 520, a cover front side 540, and cover lateral sides 560.

The cover upper side 520 forms the upper appearance of the cover 500 and is formed in an about quadrangular shape. The cover upper side 520 is formed in a size corresponding to the case lower side 420 so that it can shield the open upper side of the case 400.

Also, the cover front side 540 is formed at the front end of the cover upper side 520. The cover front side 540 forms the front appearance of the case 400, and extends downward in a vertical direction from the front end of the cover upper side 520. The cover front side 540 is formed in a shape corresponding to the open front side of the case 400 so that it can completely shield the open front side of the case 400.

A knob 542 is further formed at the lower end of the cover front side 540. The knob 542 is designed for facilitating the rotation manipulation of the cover 500. The knob 542 may protrude to the front so that a user can grip the knob 542 with his fingers. Also, a separate member for gripping can be mounted.

The cover lateral sides 560 are formed on both sides, respectively, contacting the cover upper side 520 and the cover front side 540. The cover lateral sides 560 form the shapes of both lateral sides of the case 400, and extend downward in a vertical direction from both lateral ends of the cover upper side 520.

The cover lateral sides 560 extends downward in a vertical direction up to a position corresponding to the upper end of the case rear side 440 from the cover upper side 520, and is shorter more or less than the vertical length of the cover front side 540.

Also, the rotation hole 562 is formed in the about central lower potion of the cover lateral side 560. The rotation hole 562 receives the rotation protrusion 462 of the case 400 to allow the cover 500 to be rotatably coupled. The rotation holes 562 are punched in a proper size at both sides of the cover lateral sides 560 corresponding to the positions of the rotation protrusions 462.

Meanwhile, the interference protrusion 580 is formed on a portion leaning to the rear (the left of FIG. 5) from the about central portion of the cover lateral side 560. The interference protrusion 580 contacts one side of the restriction end 464 while the cover 500 rotates to restrict the rotation of the cover 500. The interference protrusion 580 protrudes outward from the cover lateral side 560.

The interference protrusion 580 is located in the rear further than the rotation hole 562, and may be formed on a position that allows the interference protrusion 580 to contact the upper edge of the restriction end 464 while the cover 500 is closed. Also, the interference protrusion 580 contacts the restriction end 464 while the cover 500 is closed. When the cover 500 is rotated and opened, the interference protrusion 580 is detached from the restriction end 464.

Therefore, since the interference protrusion 580 is distant away from the restriction end 464 when the cover 500 is opened, the rotation of the cover 500 is not restricted by the restriction end 464. On the other hand, when the cover 500 is closed, the interference protrusion 580 comes into contact with the restriction end 464 at a point at which the rotation of the cover 500 is completed.

Meanwhile, the shape of the interference protuberance 580 is described in more detail with reference to FIG. 6. The interference protuberance 580 includes a protrusion portion 582 and a restriction portion 584.

The protrusion portion 582 extends outward by a predetermined length from both sides of the cover 500. The protrusion portion 582 is formed to have an about circular cross-section and to have a greater length than the thickness of the restriction end 464 to allow swift contact with the restriction end 464.

The restriction portion 584 extends perpendicularly to the lateral direction along the periphery of the protrusion portion 582, and is formed in an about circular shape when seen from the lateral side. The diameter of the restriction portion 584 is formed greater than that of the protrusion portion 582 to allow more stable contact with the restriction end 464.

Also, as the restriction portion 584 is formed, a recess portion 586 is formed between the restriction portion 584 and the lateral side of the cover 500. The recess portion 586 is formed greater more or less than the thickness of the restriction end 464 to receive the restriction end 464. The recess portion 586 can be formed to correspond to the thickness of the restriction end 464 so that the cover 500 does not move when the cover 500 is shielded.

The interference protrusion 580 can be integrally formed while the cover 500 is injection-molded, and can be coupled to the cover 500 if necessary. Also, in the case where the interference protuberance 580 is coupled, the interference protuberance 580 is formed of an elastic material such as rubber and silicon to relieve an impact and a noise generated by a shielding operation of the cover 500 during which the interference protrusion 580 and the restriction end 464 contact each other.

The operation of the door basket for the refrigerator having the above construction will be described with reference to the accompanying drawings.

FIGS. 7 and 8 are side cross-sectional views illustrating a door basket of a refrigerator according to an embodiment is closed/opened.

The closed state of the cover 500 is described with reference to FIG. 7. The cover 500 shields the front side and the upper side of the case 400 to shield the inner side of the case 400, that is, the receiving space of the door basket 300.

That is, when the cover 500 is closed, the lower end of the cover front side 540 is adjacent to the front end of the case lower side 420, and the interference protrusion 580 of the cover 500 contacts the upper edge of the restriction end 464 of the case 400.

When the interference protrusion 580 and the restriction end 464 contact each other, a fine gap may be generated between the cover front side 540 and the case lower side 420. With this structure, the rotation of the cover 500 can be restricted by contact between the interference protrusion 580 and the restriction end 464 without direct collision between the cover 500 and the case 400 during a rotation manipulation of closing the cover 500.

With this construction, cooling air inside the refrigerator main body 100 cannot directly flow into the door basket 300, so that the storage environment of the door basket 300 can have temperature and humidity suitable for storing milk products such as cheese and butter.

Also, to put in and take out food to be stored to/from the inside of the case 400 with the cover 500 closed, the cover 500 is raised to open the door basket 300. At this point, the cover rotates in the clockwise direction around the rotation protrusion 462 by a manipulation of raising the cover 500. As the cover 500 rotates, the interference protrusion 580 of the cover 500 also rotates in the clockwise direction.

When the cover 500 continues to rotate in the clockwise direction, the inside of the case 400 is open to expose the inner space of the door basket 300.

The open state of the cover 500 is described with reference to FIG. 8. The cover 500 rotates by about 90 from the state of FIG. 7 to open the front side of the case 400, that is, to allow the door basket 300 to be open to the front. Therefore, the receiving space of the door basket 300 is exposed to the outside.

In more detail, as the cover 500 rotates clockwise from the state of FIG. 7, the rear end of the cover upper side 520 moves to the lower direction while drawing a circular arc, and gradually gets close to the supports 480 provided to the case 400.

When the cover 500 continues to rotate in the clockwise direction, the rear end of the cover upper side 520 contacts the upper surfaces of the supports 480. At this point, the contact member 482 that can relieve an impact is provided to the upper surface of the support 480. The contact member 482 relieves an impact caused by contact between the cover upper side 520 and the contact member 482.

As the cover 500 contacts the contact member 482, the cover 500 is restricted in its clockwise rotation and does not rotate any more. With this state, the front side of the case 400 is completely open and the case 400 becomes a state illustrated in FIG. 8. At this point, the cover front side 540 shields the open upper side of the case 400, so that an operation of opening the receiving space of the door basket 300 is completed.

When the receiving space of the door basket 300 is completely opened, a user can take out food stored in the receiving space or put in food to be stored in the receiving space.

Meanwhile, to close the cover 500, the cover 500 should be lowered with the knob 542 of the cover 500 gripped, and rotated in the counterclockwise direction. When the cover 500 is rotated in the counterclockwise direction completely, the case 400 becomes the state illustrated in FIG. 7 to completely shield the receiving space of the door basket 300.

At this point, as the interference protrusion 580 of the cover 500 and the restriction end 464 of the case 400 contact each other, the rotation of the cover 500 can be ended. Since the interference protrusion 580 is located at a relatively close distance from the rotation protrusion 462 serving as the rotation center of the cover 500, the interference protrusion 580 and the restriction end 464 can contact each other without a large impact.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A door basket for a refrigerator, the door basket comprising:

a case configured to be detachably coupled to a rear side of a refrigerator door and forming a space for receiving food;

a cover axially coupled between both sides of the case and selectively shielding the case through an up/down rotation;

a contact member on the case contacting the cover when the cover is completely opened, and formed of an elastic material;

an interference protrusion protruded outwardly from each side of the cover, and formed of an elastic material;

a restriction end on each side of the case, the restriction ends contacting the interference protrusions to restrict rotation of the cover when the cover is closed;

wherein the restriction end has a first end recessed forwardly from a rear end of the case and a second end forwardly spaced from the first end of the restriction end; wherein a lower end of each restriction end is parallel to a lower side of the case; the second end of the restriction end inclines forwardly as the second end extends from a lower direction to an upper direction; and an upper end of the restriction end is bent upwardly and has a predetermined curvature.

2. The door basket according to claim 1, wherein a corner portion formed by the upper end of the restriction end and the second end of the restriction end has a rounded shape to stably contact the interference protrusions.

3. The door basket according to claim 1, further comprising a rotation protrusion on each side of the case, wherein the restriction ends are located rearwardly of the rotation protrusions.

4. The door basket according to claim 1, wherein a support supporting the cover when the cover is completely opened is provided at left and right corners inside the case.

5. The door basket according to claim 4, wherein the contact member is mounted on an upper surface of the support.

6. The door basket according to claim 1, wherein each restriction end is located rearwardly of a rotation center of the cover.

7. The door basket according to claim 1, wherein each restriction end contacts one of the interference protrusions right before the cover is completely closed.

8. The door basket according to claim 1, wherein each of the interference protrusions comprises:

a protrusion portion extending in a lateral side direction of the cover; and a restriction portion perpendicularly extending along an outer end of the protrusion portion.

9. The door basket according to claim 8, wherein a recess portion having a width corresponding to a thickness of the restriction end is provided between an inner side of the cover and the restriction portion.

* * * * *